US005823276A

United States Patent [19]

Beck, III

[11] Patent Number: 5,823,276

[45] Date of Patent: Oct. 20, 1998

[54] DIAMOND-TIPPED CORE BARREL AND METHOD OF USING SAME

[76] Inventor: August H. Beck, III, 10 Hearthwood, San Antonio, Tex. 78248

[21] Appl. No.: 780,097

[22] Filed: Dec. 24, 1996

[51] Int. Cl.[6] ..... F21B 10/48; F02D 5/34

[52] U.S. Cl. ..... 175/405.1; 299/41.1; 405/239; 408/204

[58] Field of Search ..... 299/41.1; 175/403, 175/405.1; 405/239, 240, 241, 242, 267; 125/20; 408/59, 204

[56] References Cited

U.S. PATENT DOCUMENTS

| | | | |
|---|---|---|---|
| 3,304 | 2/1843 | Leschot | 241/30 |
| 51,814 | 2/1866 | Dow | 175/405.1 |
| 922,649 | 3/1909 | Williams et al. . | |
| 922,650 | 5/1909 | Williams et al. | 408/59 |
| 1,506,119 | 8/1924 | Hansen | 175/405.1 |
| 2,343,793 | 3/1944 | Paget | 175/249 |
| 2,818,233 | 12/1957 | Williams, Jr. | 175/405.1 |
| 3,692,127 | 9/1972 | Hampe et al. | 175/405.1 |
| 3,999,619 | 12/1976 | Watson | 175/403 |
| 4,968,101 | 11/1990 | Bossow | 299/41.1 |
| 5,025,871 | 6/1991 | Stewart et al. | 175/57 |
| 5,069,584 | 12/1991 | Obermeier et al. | 125/20 X |
| 5,393,175 | 2/1995 | Courville | 408/204 X |
| 5,470,131 | 11/1995 | Nolan et al. | 299/41.1 |

OTHER PUBLICATIONS

Longyear Diamond Bits Brochure, 1981.

*Primary Examiner*—David J. Bagnell
*Attorney, Agent, or Firm*—Charles W. Hanor; Kirt S. O'Neill

[57] ABSTRACT

A relatively large diameter core barrel has a plurality of diamond cutting elements disposed around the circumference of its working end for drilling piles in very hard ground, such as metamorphic rocks and igneous rocks. Each cutting element is designed for quick and simple replacement in the field. The cutting elements are of diamond composition, and provide a substantially flat cutting face for cutting principally through abrasion at the interface of the cutting element and the hard ground to be drilled.

Piles are constructed using the diamond-tipped core barrel by first drilling an annular kerf in the ground. Circulating drilling fluid cools the diamond cutting elements and washes cuttings from the kerf during drilling. The drilled core may be removed, or it may remain in situ, with the kerf being filled by cementitious material or by a structural steel casement to form a very strong pile.

25 Claims, 7 Drawing Sheets

DIAMOND-TIPPED CORE BARREL AND METHOD OF USING SAME

FIELD OF THE INVENTION

The invention relates generally to techniques for drilling relatively large-diameter shafts for use as building foundation piles or secant wall piles, and more particularly to closed core barrels for constructing piling in super hard ground such as igneous rock and the like.

BACKGROUND OF THE INVENTION

In the foundation drilling industry, it is desired to drill relatively large diameter shafts (on the order of 36 inches to 48 inches and up) in the earth, and these shafts are typically filled with reinforced concrete to form foundation piles for buildings, bridges, etc. In the so-called drill shaft construction technique, a large diameter, hollow core barrel is rotated so that cutters on its lower edge cut an annular kerf in the ground. Once this kerf is drilled to the desired depth by the core barrel's cutting face, the earthen core within the kerf may be broken off and removed to permit the shaft to be filled with reinforced concrete for forming a pile. Alternatively, the core may be left in place, with the pile being formed by filling the annular kerf with cementitious material, steel casement, or other suitable means for forming the outermost portion of the pile. An example of the latter technique is a cast-in-place shell pile, which is disclosed in my U.S. application Ser. No. 08/743,980 filed Oct. 31, 1996, the contents of which are incorporated herein by reference.

The effectiveness of conventional drill shaft construction techniques is substantially diminished when drilling in very hard earth due to the inherent limitations of conventional cutting surfaces. Hard earthen materials which impede drill shaft construction include super hard rock materials, examples of which are sedimentary rock like chert-laden dolomite; metamorphic rocks like highly siliceous schists; and igneous rocks like headstone-quality granite. Conventional drill shaft construction cutting surfaces include tungsten carbide, which is typically added to the bottom of the core barrel in a manufactured tooth that fits into a weld-on pocket at the bottom of the barrel. Alternatively, the cutting action may be provided by a build-up of hard facing containing tungsten carbide. These cutting surfaces provide acceptable results for moderately hard rock, but do not perform well in super hard rock.

In the prior art, there are also rotating, double-walled core barrels that have roller bits as the cutting surface. These roller bits are typically welded to the bottom of the barrel. As the core barrel rotates and the cutters scrape cuttings from the bottom of the kerf, air under high pressure is circulated down between the double walls via a swivel through the rotary, thereby flushing cuttings up past the outer diameter of the core barrel and out of the kerf. This technique requires extreme downward pressure on the core barrel and large volumes of compressed air. Furthermore, it is of limited use when water is present in the earthen material to be drilled, or when it is anticipated that the core barrel will encouter soft zones of earth, such as clay, which will clog the rotating cutters.

The limitations of tungsten carbide have been partially addressed by the use of diamond cutting surfaces, which are more effective for cutting super hard materials. For example, it is known to use small-diameter, high-speed core bits with diamonds on the cutting face in geotechnical exploration, hard rock mineral exploration, oil field coring operations, and concrete coring operations. These core barrels typically have diameters of about two inches in the geotechnical field, although slightly larger diameters may be used for oil field work or in mineral exploration. On the cutting face, they may employ cut diamonds which are set during the manufacture of the core bit to provide pointed cutting elements, as shown for example in U.S. Pat. Nos. 3,692,127 to Hampe et al.; 2,818,233 to Williams, Jr.; and Re. 3,304 to Leschot. The more modern of these small-diameter core bits employ cutting surfaces formed of diamond-impregnated abrasive compacts. An example of this latter core bit is found in U.S. Pat. No. 5,025,871 to Stewart et al., wherein the diamond-impregnated composition is formed into cutting elements having a cutting point. However, none of these prior art core bits are suitable for large-diameter drilling, and none have cutting elements which are easily installed in the field.

Heretofore, only limited use has been made of diamond cutting surfaces in relatively large diameter applications. There exist some relatively large diameter (approximately 36 inches) coring bits for concrete coring and architectural cutting of granite for columns. These coring bits, however, are light-duty pieces of equipment that cannot withstand the high interface pressures present at the working end of a core barrel used in drilled shaft construction.

Heretofore, no use has been made of diamond cutting surfaces in drilled shaft applications in the foundation drilling industry. One reason is the large forces exerted on the cutting elements of large-diameter core barrels during handling, placement and use when working in super hard materials such as igneous rock. Under such working conditions, diamonds secured to the cutting surface of the core barrel are easily dislodged, and field replacement of conventional diamond cutting elements, such as those shown in U.S. Pat. No. 922,650 to Williams, Jr. et al., is not practicable. For large-diameter core barrels, which can be 6 feet in diameter or more and can exceed 35 feet in length, the inability to efficiently replace dislodged cutting elements in the field renders the core barrel useless, since it is usually not possible to delay a construction job for an extended period while the core barrel is transported back to the factory for repairs.

SUMMARY OF THE INVENTION

An object of the present invention is to provide an improved core barrel suitable for drill shaft construction in very hard earthen material, including rock.

A further object of the present invention is to provide a relatively large-diameter core barrel having cutting elements composed at least in part of diamond material.

A further object of the present invention is to provide a core barrel for drilling foundation piles or secant wall piles in hard rock, wherein the core barrel includes cutting elements which are easily replaced in the field.

A still further object of the present invention is to provide a method of constructing a foundation pile or a secant wall pile in hard earthen material using a core barrel having cutting elements composed at least in part of diamond material.

A still further object of the present invention is to provide a foundation pile or a secant wall pile formed in hard earthen material by placing a steel casement into an annular kerf cut by a core barrel having cutting elements composed at least in part of diamond material.

A still further object of the present invention is to provide a method of drilling a foundation pile or a secant wall pile in super hard rock using diamond cutting elements which are cooled and washed during drilling to increase the efficiency of the drilling operation.

In satisfaction of these and other objects, the invention provides a single-wall core barrel with a plurality of cutting elements disposed around its circumference at its working end. The cutting elements are composed of diamond-impregnated material, and each cutting element is adapted to be secured to the lower edge of the core barrel by means such as soldering. The cutting elements are shaped to enable the quick and efficient replacement of the cutting element in the field. The cutting elements are of diamond composition, and provide a substantially flat cutting face for cutting an annular kerf in hard earthen material such as rock principally through abrasion at the interface of the cutting element and the rock.

The importance of easy field replacement of the diamond cutting elements will be immediately recognized to those skilled in the art. In drilled shaft construction, numerous opportunities for damaging the diamond cutting elements are presented. Transportation of the core barrel, handling the core barrel during transportation, set-up and storage, and inserting and withdrawing the core barrel from a kerf all pose the potential for damaging or dislodging a cutting element. In addition, the use of the core barrel will wear out the diamond cutting elements with time. It is therefore desirable to install and remove the diamond cutting elements quickly and simply.

The core barrel has a diameter suitable for drilling foundation piles for buildings and the like. The diameter of the core barrel is typically 36–48 inches, although diameters of 72 inches or more may be realized. In practice, the diameter will be at least about 18 inches to produce piles suitable for use in foundations and related systems, such as secant pile walls. The length of the core barrel is substantially greater than its diameter, enabling the drilling of kerfs which are on the order of 25 ft.–50 ft. deep and greater.

In operation, the core barrel is rotated by a top drive rotary or kelly on a conventional drilling rig. Prior to drilling with a diamond-tipped core barrel, the rock may be leveled with a second, different core barrel to create a starting kerf. This second core barrel may be provided with conventional cutting elements such as those made of Tungsten carbide or like materials. The starting kerf keeps the bottom of the diamond-tipped core barrel centered and prevents dancing or walking, which can damage the diamond cutters. Before placing the diamond-tipped core barrel in the starting kerf, it may be necessary to clean the kerf of cuttings deposited by the Tungsten barrel.

Once any necessary starting kerf is completed, the diamond-tipped core barrel is positioned in the kerf for drilling the remainder of the kerf. The diamond-tipped core barrel is nominally closed at its top end, but has an opening therein for admitting a drilling fluid delivered thereto via a conduit connected to a swivel means located above the top drive rotary. As the core barrel is rotated to cut an annular kerf, drilling fluid such as polymer water or bentonite is pumped downward into the interior of the core barrel, between the core and the core barrel wall, toward the diamond cutters. The drilling fluid flows across the cutters, simultaneously cooling the cutters and washing the bottom of the kerf of cuttings dislodged by the diamond cutters. Because the diamond cutters remove the cuttings principally through abrasion at the cutting face of the cutters, the cuttings tend to be very fine, and are thus easily suspended in the drilling fluid. The drilling fluid, laden with cuttings, then exits the kerf upward between the outside diameter of the core barrel and the excavated wall of the shaft. Such a closed circulating system is particularly advantageous for obtaining long diamond life and good cutting results.

The nominally closed-top, diamond-tipped core barrel of the present invention has significant advantages over conventional core barrels used in the foundation drilling industry. Conventional core barrels are typically 3 ft. to 5 ft. in length and do not have a closed top for forced circulation of a drilling fluid. Once the cuttings start accumulating, the conventional barrel begins to clog up, creating higher torque requirements, reduced cutting action and eventually seizure of the barrel in the kerf. To continue advancing, the core barrel must be removed, the cut core must be removed from the shaft (usually by beating or augering), and the process repeated. Advancement of the kerf using such conventional techniques Is usually limited to 1 ft. to 3 ft. per operation. With the pressurized circulating core barrel of the present invention, the process can continue without interruption the full length of the barrel, which could be 15 ft., 20 ft., or even 50 ft. or more. Moreover, because the core need not be removed to clean the kerf, the method of the present invention permits the construction of extremely strong piles comprising the in situ hard earthen core surrounded by metallic casement or the like, as will now be described.

Once the kerf is drilled to the desired depth, the foundation pile or secant wall pile is constructed. According to one aspect of the invention, the core barrel is withdrawn from the kerf, and the core is removed by any conventional technique. The resultant excavation may be cleaned, and then filled with cementitious material (such as concrete) and reinforcing steel to complete the pile.

According to another aspect of the invention, the hard core is left in place to form the interior portion of a structural pile. In this aspect, the drilled annular kerf is filled with cementitious material, or a combination of cementitious material and reinforcing steel. Alternatively, a full-length metallic casing, such as steel, is placed in the annular kerf. If necessary, the annular spaces on both sides of the shell casing may then be grouted with cementitious material, sand or the like.

In still another aspect of the invention, the diamond-tipped core barrel is left in the annular kerf after drilling is completed, thus sacrificing the diamond cutters so that the core barrel itself provides the metallic casing of the foundation pile or secant wall pile.

When the method of the present invention is employed to construct a pile having a structural hard earthen core, another advantage is the ease of integrity testing of the completed piles. The structural engineer will already know the rock integrity, and he will learn the top of rock elevation and the penetration and the integrity of the fabricated pipe pile. Also, if there were a rock integrity question, the pile would be a platform for a small testing rig to run a core through the center of the pile.

BRIEF DESCRIPTION OF THE DRAWINGS

The present invention is more easily understood with reference to the drawings, in which.

DETAILED DESCRIPTION OF THE PREFERRED EMBODIMENT

Figure 1A:
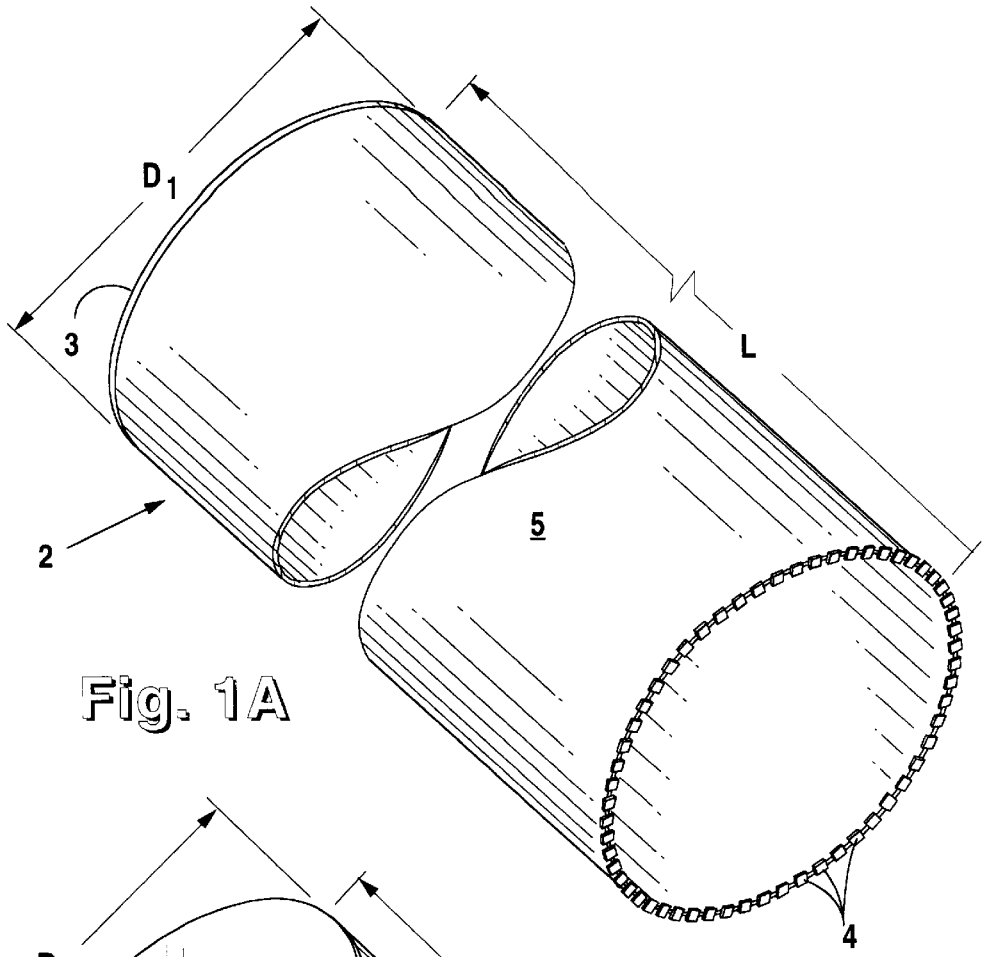
FIG. 1A is a bottom isometric view of a diamond-tipped core barrel according to the present invention.
Figure 1B:
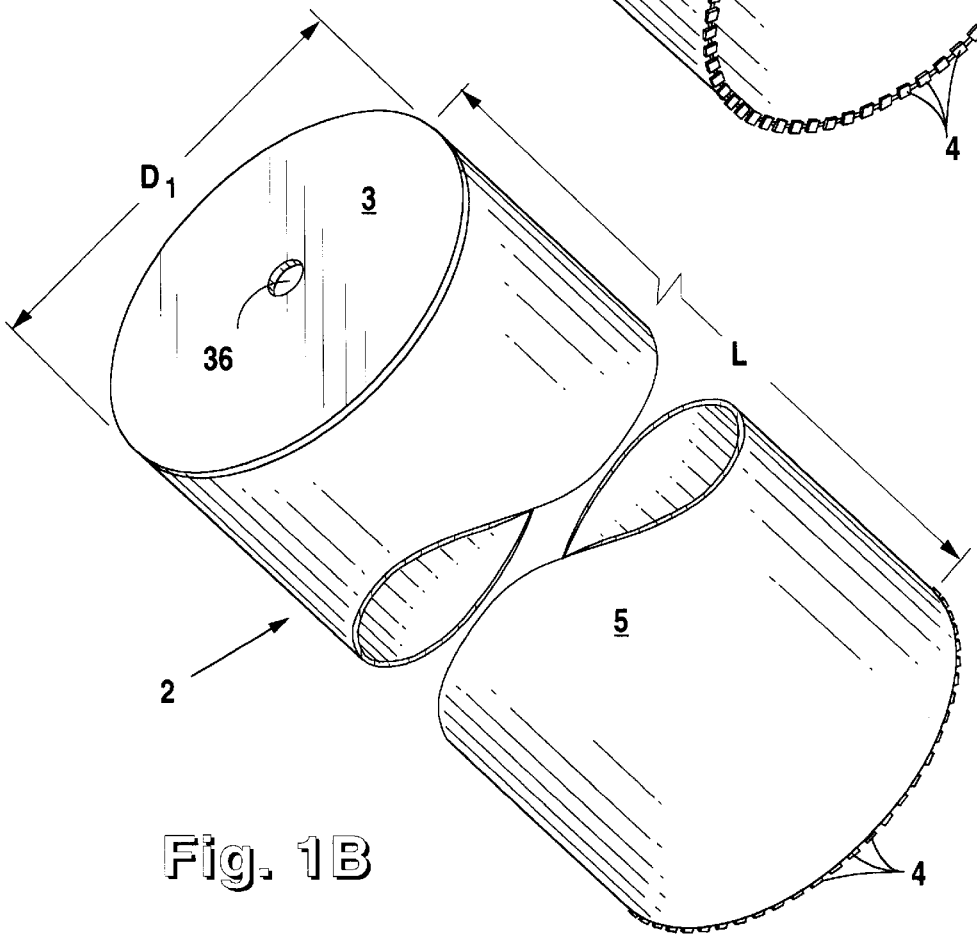
FIG. 1B is a top isometric view of the diamond-tipped core barrel of FIG. 1A.

There is shown in FIG. 1A a single-wall core barrel 2 for drilling an annular kerf in hard ground. The core barrel has an outer diameter $D_1$ which is at least about 18 inches, but will typically be in the range of 24 inches to 48 inches, depending on the particular requirements of the foundation system or secant pile wall which is to be constructed. For very large foundation systems, $D_1$ may be 72 inches or more. Core barrel 2 has a length L which will likewise depend on the depth requirements of the foundation system or secant wall pile to be constructed, but in any event is usually at least about two times the outer diameter $D_1$. As shown in FIG. 1B, core barrel 2 has a nominally closed top 3, but is provided with at least one opening 36 proximate the top of the core barrel for admitting a drilling fluid into the interior of the core barrel during drilling, as will be described with particular reference to FIG. 5 below.

Figure 2:
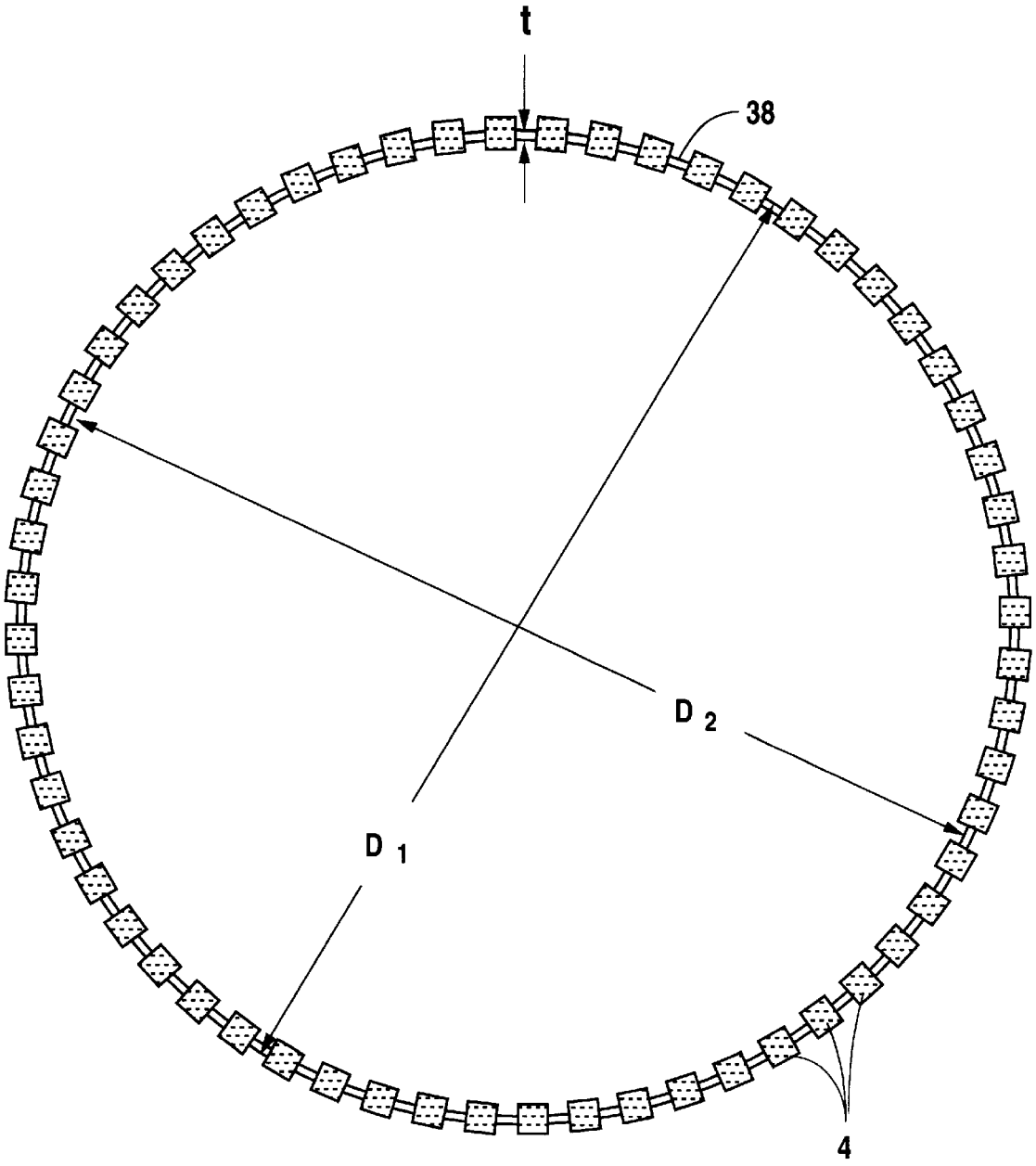
FIG. 2 is a bottom plan view of the core barrel of FIG. 1A, particularly showing the plurality of diamond cutters thereon.

Core barrel 2 is provided at its working end 5 with a plurality of cutters 4 consisting at least in part of diamond. FIG. 2 illustrates a typical arrangement of a plurality of diamond cutters 4 affixed to the lower end of wall 38 of the core barrel. Core barrel wall 38 has a thickness $t_1$, which is one-half the difference between the core barrel's outer diameter $D_1$ and inner diameter $D_2$. A typical thickness $t_1$ is in the range of ⅜ inch to ⅝ inch, although the thickness may depend on such factors as the overall length L of the core barrel, the outer diameter $D_1$ of the core barrel, the material to be excavated, the depth to be excavated, and the wall thickness of any casement or pipe which is desired to be placed in the kerf.

Figure 3B:
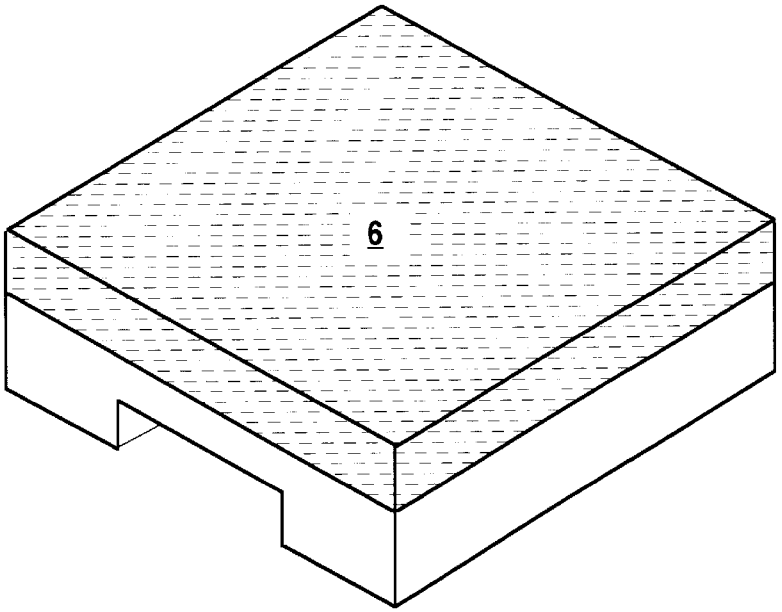
FIGS. 3A and 3B are, respectively, top and bottom isometric views of a single, field-installable diamond cutter element for use in the present invention.
Figure 3A:
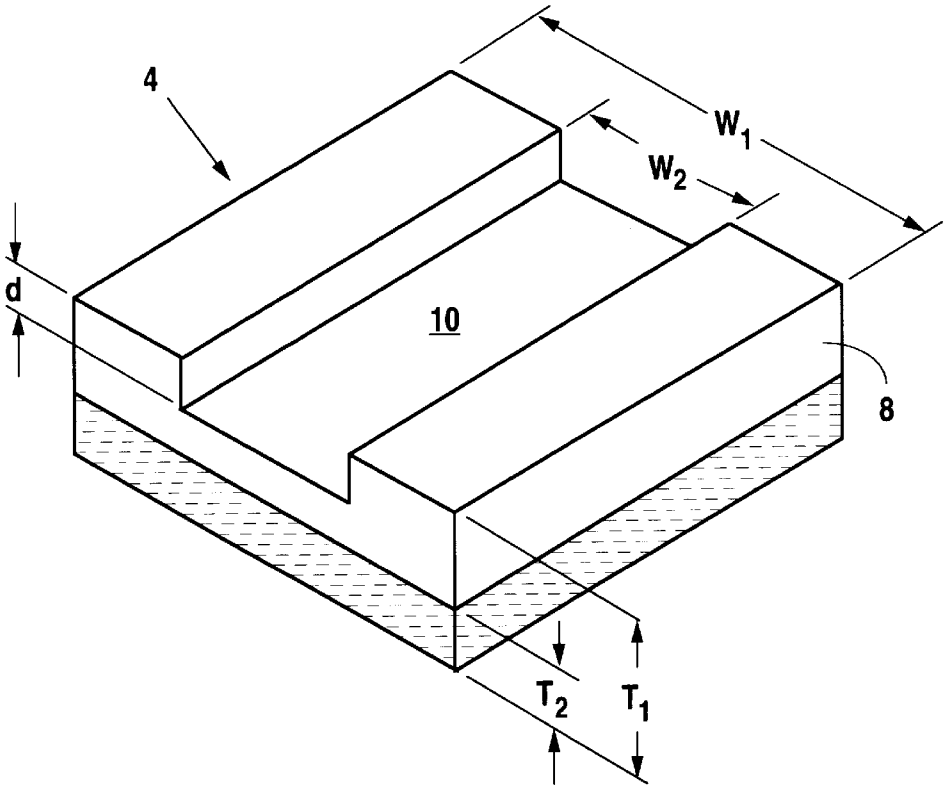

In the preferred embodiment, each diamond cutter 4 is constructed as shown in FIGS. 3A and 3B, with a view to the quick and easy replacement of any cutter in the field, should one or more cutters become excessively worn, chipped, or dislodged altogether from core barrel wall 38. As shown, each cutter 4 is preferably generally rectangular or square in horizontal cross-section. Each cutter includes a metallic cutter base 8, the composition of which is preferably selected to be suitable for soldering cutter 4 to the lower edge of core barrel wall 38. Cutter base 8 has an overall width $W_1$ and a longitudinal channel 10 formed therein of width $W_2$. Width $W_2$ is selected to allow lower wall 38 of the core barrel to be fitted snugly in channel 10 to a depth d thereof, which is selected so as to provide sufficient lateral stability to cutter 4 after it is affixed to the core barrel such as by welding. It has proved suitable to employ cutters having a base of dimensions $W_1$=⅞ inch; $W_2$=⅜ inch; d=0.093 inch.

Cutter base 8 is provided with a substantially flat cutting face 6, which preferably comprises a diamond-impregnated material. The thickness $T_2$ of cutting face 6 will vary depending on the particular application, but is preferably about 0.125 inch, yielding an overall thickness $T_1$ of cutter 4 of 0.312 inch. Cutters of the type described may be obtained from Christensen Products, P.O. Box 30777, Salt Lake City, Utah 84103. The cutters are sized to have width $W_1$ to cut a kerf of thickness $t_2$, which will be greater than the thickness $t_1$ of the core barrel wall 38, thereby to allow core barrel 2 to proceed without interference during drilling.

Channel 10 of diamond cutter 4 is ordinarily tapped onto the bottom of core barrel wall 38 and then silver soldered in place. When core barrel wall 38 is smooth and well formed at its lower end, no preparation of core barrel wall 38 is necessary. After use of the core barrel, core barrel wall 38 may become deformed or otherwise unsuitable for attachement of a diamond cutter 4 thereto. Under such circumstances, a damaged portion of core barrel wall 38 may be cut back to usable material with a cutting torch, and a grinder used to prepare the wall surface under repair.

Construction of a foundation pile or secant wall pile with the foregoing diamond-tipped core barrel is now described with reference to FIGS. 4A, 4B and 5. Leads 14 on drilling platform 12 support top drive 16, which is slidably mounted on the drilling platform. Drilling platform 12 may be a crane or excavator-type crawler, or other similar type of machinery. Top drive 16 rotates core barrel 2 suspended therefrom, preferably at speeds in the range of 30 to 80 revolutions per minute. Top drive 16 and core barrel 2 are preferably interposed by hollow drill pipe extension 30, which serves to permit lowering the core barrel completely into the ground even where the construction and elevation of drilling platform 12 are such as to prevent top drive 16 from closely approaching the ground surface. Alternatively, core barrel 2 is driven by a hollow, rotating kelly bar having a fluid swivel. Such an arrangement would enable the top of core barrel 2 to be lowered deep below the ground surface.

Figure 4B:
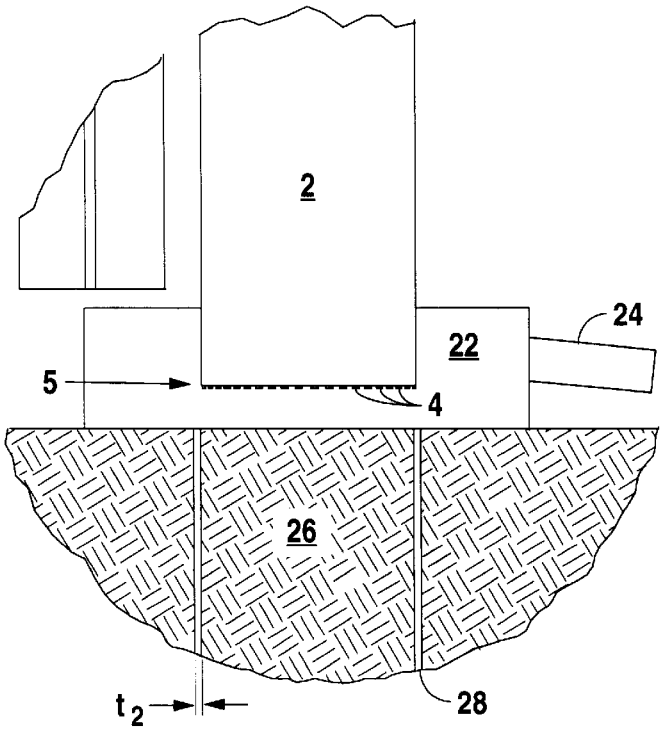
FIG. 4B is an expanded side view showing the lower portion of the diamond-tipped core barrel of FIG. 4A after withdrawal from the kerf.
Figure 4A:
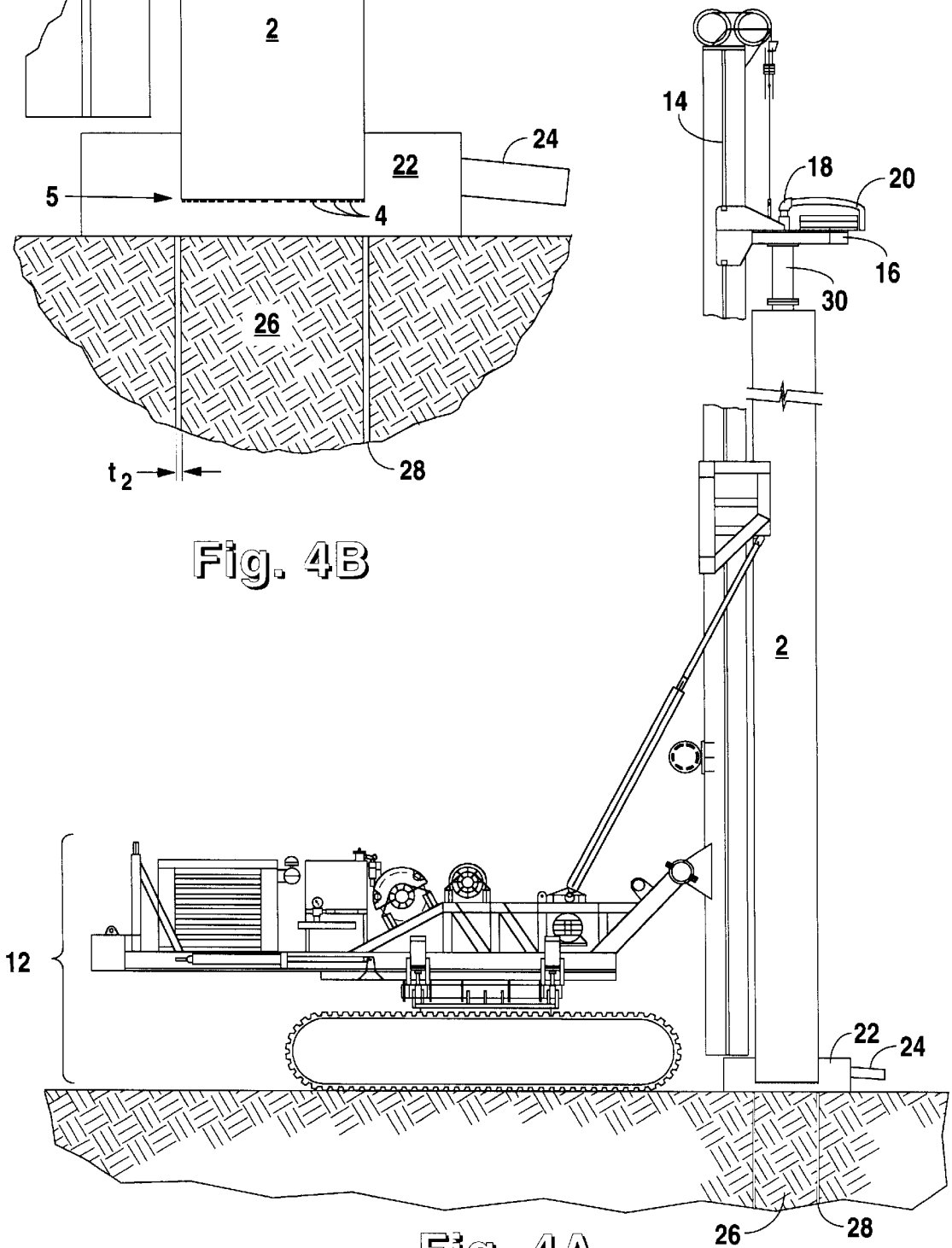
FIG. 4A is a side view of a diamond-tipped core barrel suspended in operation from a conventional drilling rig for drilling an annular kerf in super hard ground.
Figure 5:
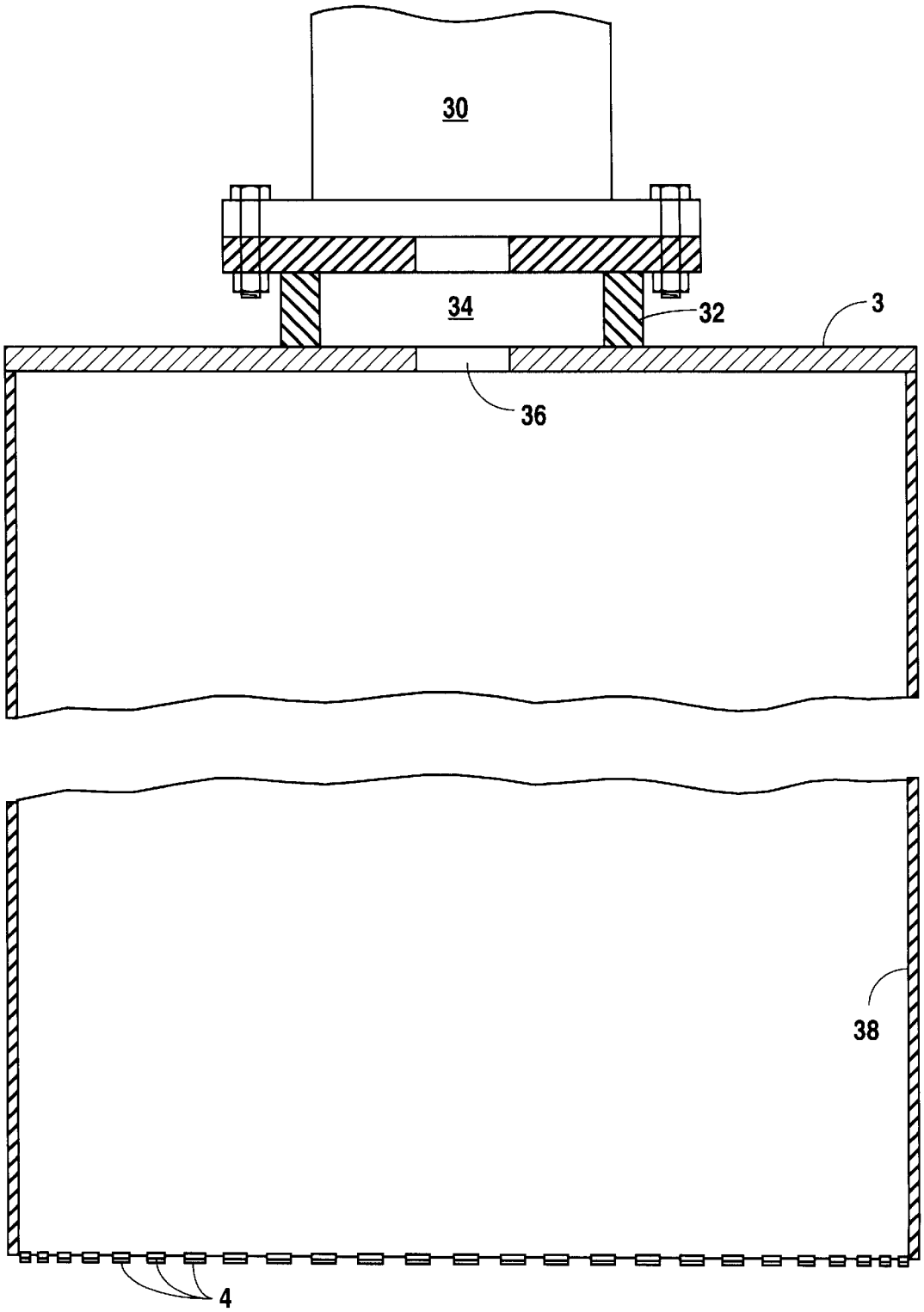
FIG. 5 is a side view in partial cross-sectional of the nominally closed-top core barrel of the present invention.

As illustrated in the enlarged view in FIG. 4B, core barrel 2 is provided at its working end 5 with a plurality of diamond cutters 4 of the type previously described. When drilling commences, core barrel 2 is rotated and lowered to the ground on leads 14, thus to begin drilling annular kerf 28 around hard earthen core 26, which may be rock or other similar hard material. When the ground to be drilled is not level or smooth, it may be necessary to start kerf 28 with a conventional core barrel having cutters composed of tungsten carbide or other suitable material for drilling hard ground. Such a starting kerf may be necessary to prevent damage and unnecessary wear of the diamond cutters 4, which can be caused by dancing or walking of core barrel 2 on uneven ground.

Drilling proceeds as core barrel 2 is lowered into kerf 28, thereby cutting around core 26. Cutters 4 are composed at least in part of diamond, and are preferably made of a diamond-impregnated compound. Each cutter 4 has a substantially flat cutting face 6 (FIG. 3B), which operates to cut kerf 28 primarily through a process of abrasion on the bottom of the kerf, in contrast to many conventional cutters which gouge the earthen surface and cut away relatively large fragments. The use of abrasive diamond cutting surfaces makes it unnecessary to carefully align and position a cutting edge of a diamond, as is required by much of the prior art. Because precise setting of diamonds is not required, the described construction of cutters 4 is permitted, and these cutters may be quickly and easily re-affixed to core barrel wall 38 or replaced entirely by simple soldering techniques. It will be recognized that other simple forms of attachment, such as the use of locking pins to attach cutters through holes in the side of core barrel wall 38, are also possible with this invention.

Drilling is facilitated by the use of a circulating drilling fluid, which may be ordinary water, polymer water, bentonite, or other suitable solution. Preferably, drilling fluid is pumped into the interior of core barrel 2 via a filling conduit 20 connected to rotary swivel means 18 above top drive rotary 16. As illustrated in FIG. 5, drilling fluid flows down through drill pipe extension 30 and into cavity 34 of neck 32 of the core barrel. Thereafter, drilling fluid preferably enters the core barrel through opening 36 in its top 3. Under pressure, the drilling fluid is forced to circulate down between core 26 and core barrel wall 38 and across cutters 4, thereby washing cuttings away from the cutters and simultaneously cooling the cutters. The cuttings, which are primarily the result of the above described abrasion process, easily become suspended in the drilling fluid and are carried upward to the surface past the outer diameter of core barrel 2. These steps of washing the cuttings out of the kerf and cooling the diamond cutters 4 provide for greatly increased drilling speed and efficiency over conventional dry drilling techniques.

As shown in FIG. 4B, drilling fluid exiting kerf 28 is preferably received in conductor 22, which may simply be short pipe placed around the top of the kerf to catch exiting drilling fluid. The accumulation of drilling fluid in conductor 22 permits the drilling fluid to be drawn off through return conduit 24 for possible re-use in the system after the cuttings are allowed to settle or are filtered out of the drilling fluid.

Once the annular kerf 28 is drilled to the desired depth, core barrel 2 is preferably withdrawn, leaving very hard earthen core 26 behind. It is then possible to construct piles in the usual manner, wherein core 26 is removed, and the resulting excavation is filled by placing a cementitious material such as concrete into the kerf. Steel reinforcing bars may also be placed vertically in the excavation prior to filling with cementitious material.

Alternatively, and more advantageously, core 26 remains in place after core barrel 2 is withdrawn from the kerf. A rigid foundation pile with very high load bearing capacity is then constructed by placing a suitable casing material in kerf 28. In one embodiment, reinforcing steel bars are placed longitudinally into kerf 28. The kerf is then filled by placing a cementitious material therein.

Figure 6:
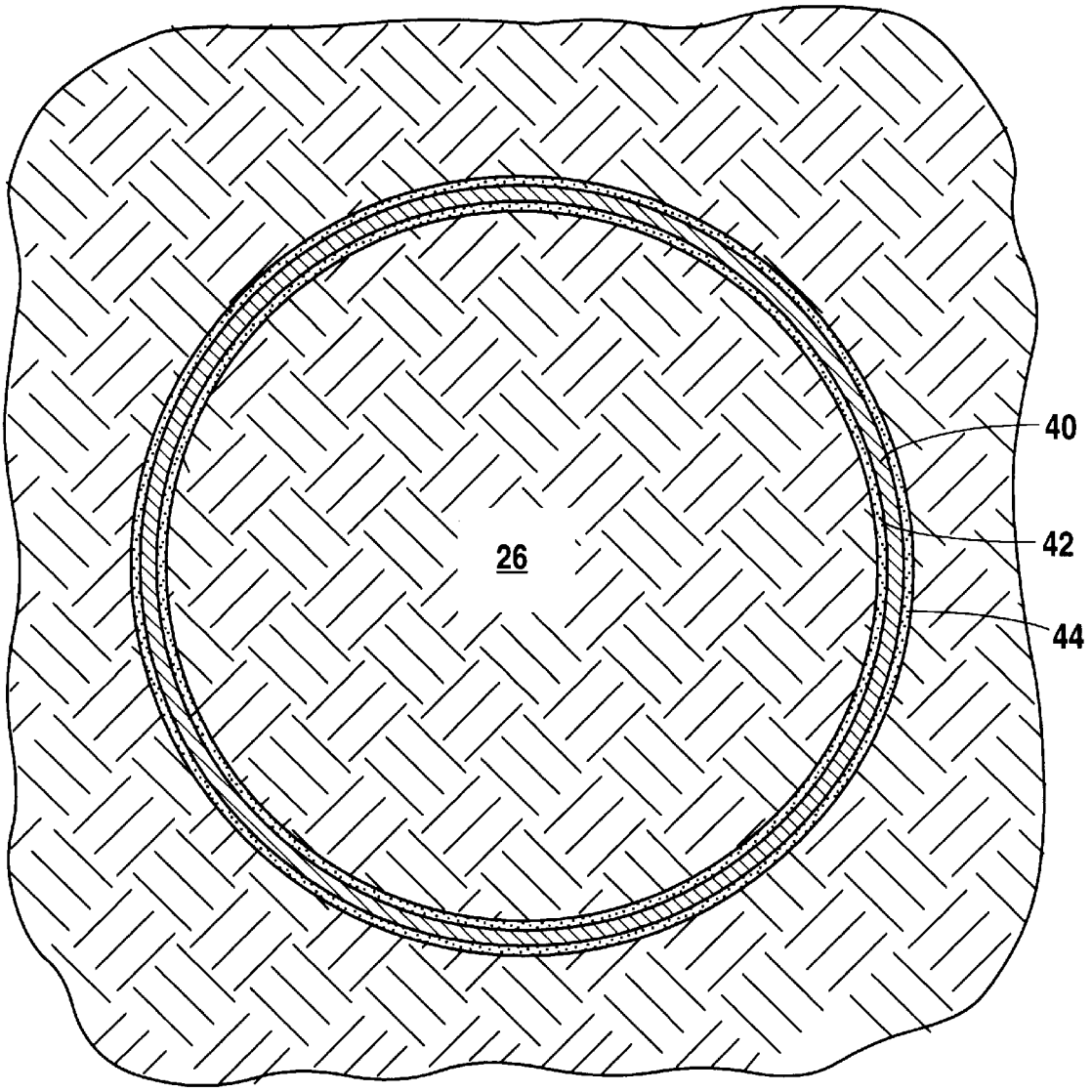
FIG. 6 is a top plan view of a pile formed of full-length, structural steel casing surrounding a super hard earthen core.

In the embodiment illustrated in FIG. 6, metallic casement 40 is placed in kerf 28 to form the exterior structural component of the pile. Metallic casement 40 is preferably steel and extends the entire depth of the kerf 28 and slightly thereabove to an elevation which allows the attachment of a building foundation thereto (i.e., has a length somewhat greater than the depth of the kerf). Casement 40 will typically have a thickness less than the thickness $t_2$ of annular kerf 28 to allow easier insertion of the casement. Under these circumstances an inner annulus 42 and outer annulus 44 remain after metallic casement 40 is inserted into the kerf. These annuluses may be grouted with cementitious material, sand or the like if desired. This construction provides a very strong structural pile. In addition, when non-cementitious material such as sand is used as the grout, such a foundation pile does not require that cement be mixed or transported to the construction site, thereby providing significant advantages over conventional concrete-based systems.

According to a slightly different method, the pile of FIG. 6 may be constructed by simply sacrificing core barrel 2 upon completion of drilling, leaving it in kerf 28 to provide metallic casement 40. This option may be an attractive one where drilling has left the diamond cutters is sufficiently worn so as to render them effectively spent, thereby making it uneconomical to withdraw core barrel 2 merely to replace it with other steel casing.

Figure 7:
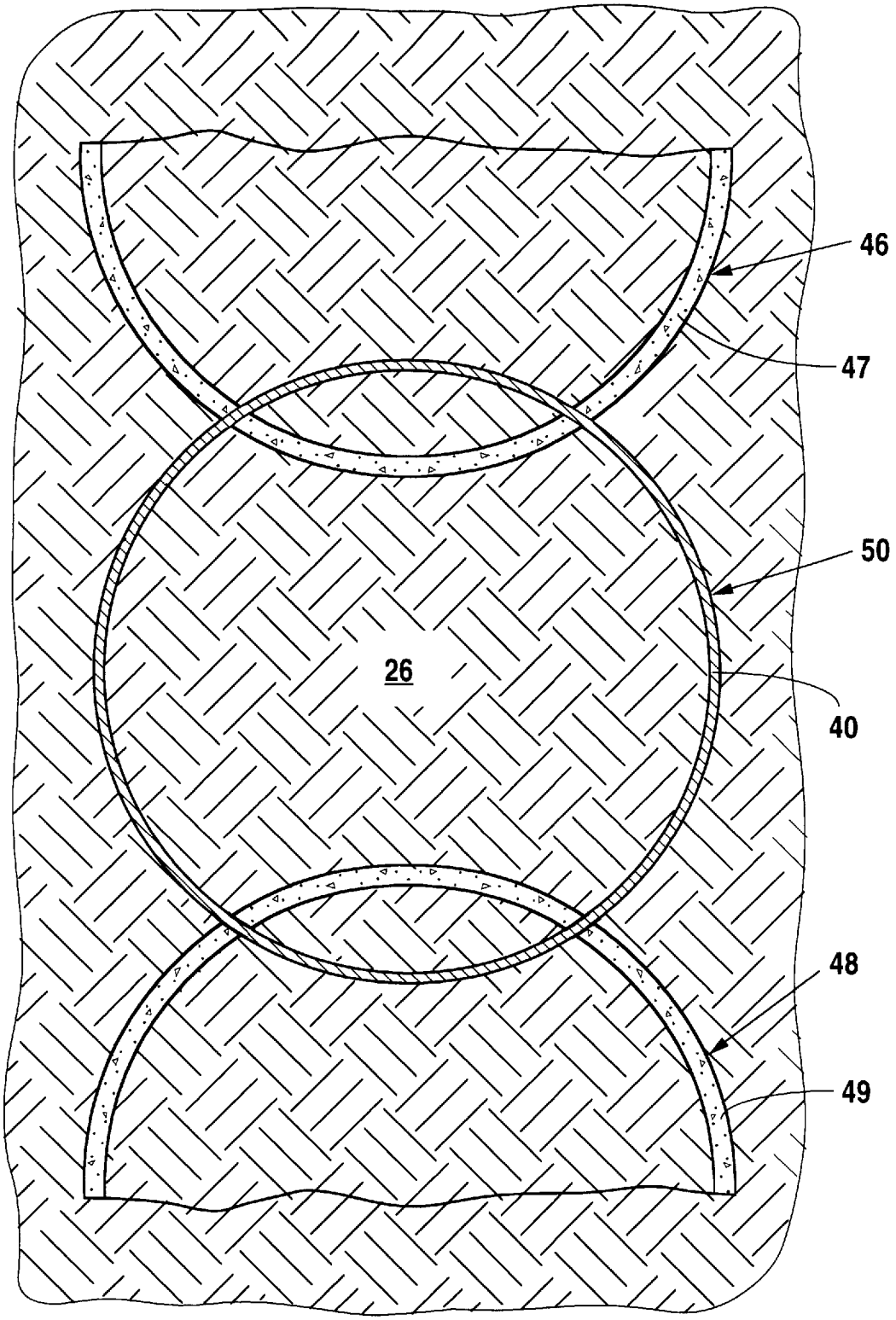
FIG. 7 is a top plan view of secant piles constructed according the method of the present invention.

The diamond-tipped core barrel of the present invention may also be used to construct secant piles in hard ground of the types described, as illustrated in FIG. 7. Secant pile walls are used to form an underground barrier for such purposes as containing environmental contamination. They are constructed from a plurality of adjacent piles, each such pile intersecting adjacent piles along its length at two points on its circumference. Any of the piles constructed from the methods described above are suitable for use as a secant pile. Preferably, though, a pile having structural metallic casement 40 is used in such a system. Not every pile in a secant pile wall can have a metallic casement due to the intersections of the walls of adjacent piles. Accordingly, it is preferable to first use a diamond-tipped core barrel to construct first cementitious pile 46 and second cementitious pile 48 a suitable distance apart, each having cementitious shells 47 and 49, respectively. After cementitious shells 47 and 49 harden, steel pile 50 is constructed according to the method above wherein metallic casement 40 surrounds hard earthen core 26. Core barrel 2 easily cuts through cementitious shells 47 and 49 of adjacent piles.

While a particular embodiment of the invention has been illustrated and described, it will be obvious to those skilled in the art that various changes and modifications may be made without sacrificing the advantages provided by the principles of construction disclosed herein.

What is claimed is:

1. A core barrel having a working end for excavating super hard ground in which foundation piles or secant wall piles are to be constructed, said core barrel having a diameter of at least about 18 inches and a length of at least about 15 feet and comprising a plurality of cutters secured to the working end of the core barrel, each of said cutters having a substantially flat cutting face formed from material composed at least in part of diamond for cutting a kerf principally by abrasion, and means formed in each of said cutters for securing the cutters to the working end of the core barrel.

2. A core barrel having a hollow interior and a working end for excavating super hard ground in which foundation piles or secant wall piles are to be constructed, said core barrel comprising:

a plurality of cutters secured to the working end of the core barrel, each of said cutters being formed from material composed at least in part of diamond;

means formed in each of said cutters for securing the cutters to the working end of the core barrel;

means for admitting a drilling fluid into the interior of said core barrel, thereby to allow the plurality of cutters to be cooled and washed during drilling; and wherein said core barrel has a diameter of at least about 18 inches and a length of at least about 15 feet.

3. The core barrel of claim 2, wherein each of said cutters has a substantially flat cutting face for cutting a kerf principally by abrasion.

4. A method of constructing a pile in very hard earth, such as rock, for use in foundation systems or underground barriers, comprising the steps of:

drilling an annular kerf in hard ground with a hollow-interior core barrel having a plurality of diamond cutters secured to a working end of the core barrel, a diameter of at least about 18 inches, and a length at least about two times its diameter;

circulating a drilling fluid downward through the interior of said core barrel and across said plurality of diamond cutters to cool and wash the cutters, thereby to excavate a relatively large diameter shaft around a hard earthen core; and sacrificing the core barrel by leaving it in the kerf, thereby to form a structural metallic casement of a pile having a hard earthen core.

5. A method of pile construction according to claim 4, wherein each of said plurality of diamond cutters has a substantially flat cutting face formed from material composed at least in part of diamond for cutting the kerf principally by abrasion.

6. A method of pile construction according to claim 5, further comprising the step of grouting the kerf on both sides of the core barrel.

7. A method of constructing a pile in very hard earth, such as rock, for use in foundation systems or underground barriers, comprising the steps of:

drilling an annular kerf in hard ground with a hollow-interior core barrel having a plurality of diamond cutters secured to a working end of the core barrel, a diameter of at least about 18 inches, and a length at least about two times its diameter:

circulating a drilling fluid downward through the interior of said core barrel and across said plurality of diamond cutters to cool and wash the cutters, thereby to excavate a relatively large diameter shaft around a hard earthen core; and withdrawing the core barrel from the kerf upon completion of said drilling step, removing the hard earthen core, and placing a cementitious material in the kerf to form a pile.

8. A method of pile construction according to claim 7, wherein each of said plurality of diamond cutters has a substantially flat cutting face formed from material composed at least in part of diamond for cutting the kerf principally by abrasion.

9. A method of constructing a pile in very hard earth, such as rock, for use in foundation systems or underground barriers, comprising the steps of:

drilling an annular kerf in hard ground with a hollow-interior core barrel having a plurality of diamond cutters secured to a working end of the core barrel, a diameter of at least about 18 inches, and a length at least about two times its diameter;

circulating a drilling fluid downward through the interior of said core barrel and across said plurality of diamond cutters to cool and wash the cutters, thereby to excavate a relatively large diameter shaft around a hard earthen core; and withdrawing the core barrel from the kerf upon completion of said drilling step and placing a cementitious material in the kerf to form a pile.

10. A method of pile construction according to claim 9, wherein each of said plurality of diamond cutters has a substantially flat cutting face formed from material composed at least in part of diamond for cutting the kerf principally by abrasion.

11. A method of pile construction according to claim 10, further comprising the step of starting the kerf with a second, different core barrel prior to the drilling step.

12. A method of pile construction according to claim 9, wherein the cementitious material extends at least substantially the entire depth of the kerf.

13. A method of pile construction according to claim 11, wherein each of said plurality of diamond cutters has a substantially flat cutting face formed from material composed at least in part of diamond for cutting the kerf principally by abrasion.

14. A method of pile construction according to claim 13, further comprising the step of starting the kerf with a second, different core barrel prior to the drilling step.

15. A method of constructing a pile in very hard earth, such as rock, for use in foundation systems or underground barriers, comprising the steps of:

drilling an annular kerf in hard ground with a hollow-interior core barrel having a plurality of diamond cutters secured to a working end of the core barrel, a diameter of at least about 18 inches, and a length at least about two times its diameter;

circulating a drilling fluid downward through the interior of said core barrel and across said plurality of diamond cutters to cool and wash the cutters, thereby to excavate a relatively large diameter shaft around a hard earthen core; and withdrawing the core barrel from the kerf upon completion of said drilling step and placing a metallic casement in the kerf to form a pile.

16. A method of pile construction according to claim 15, wherein each of said plurality of diamond cutters has a substantially flat cutting face formed from material composed at least in part of diamond for cutting the kerf principally by abrasion.

17. A method of pile construction according to claim 16, further comprising the step of starting the kerf with a second, different core barrel prior to the drilling step.

18. A method of pile construction according to claim 15, wherein the metallic casement extends at least substantially the entire depth of the kerf.

19. A method of pile construction according to claim 18, wherein each of said plurality of diamond cutters has a substantially flat cutting face formed from material composed at least in part of diamond for cutting the kerf principally by abrasion.

20. A method of constructing a pile in very hard earth, such as rock, for use in foundation systems or underground barriers, comprising the steps of:

drilling an annular kerf in hard ground with a hollow-interior core barrel having a plurality of diamond cutters secured to a working end of the core barrel, a diameter of at least about 18 inches, and a length at least about two times its diameter, each of said plurality of diamond cutters having a substantially flat cutting face formed from material composed at least in part of diamond for cutting the kerf principally by abrasion;

circulating a drilling fluid downward through the interior of said core barrel and across said plurality of diamond cutters to cool and wash the cutters;

withdrawing the core barrel from the kerf upon completion of said drilling step;

placing a metallic casement in the kerf, said metallic casement extending at least substantially the entire depth of the kerf; and grouting the kerf on both sides of the metallic casement.

21. A method of pile construction according to claim 20, further comprising the step of starting the kerf with a second, different core barrel prior to the drilling step.

22. A pile formed in very hard earth, such as rock, for use in foundation systems or underground barriers, comprising a hollow-interior core barrel disposed in an annular kerf in hard ground, said core barrel having a plurality of diamond cutters secured to a working end of the core barrel, a diameter of at least about 18 inches, and a length at least about two times its diameter.

23. The pile of claim 22, further comprising grout in the kerf on both sides of the core barrel.

24. A method of constructing a pile in very hard earth, such as rock, for use in foundation systems or underground barriers, comprising the steps of:

drilling an annular kerf in hard ground with a hollow-interior core barrel having a plurality of diamond cutters secured to a working end of the core barrel, a diameter of at least about 18 inches and a length of at least about 15 feet and comprising; and circulating a drilling fluid downward through the interior of said core barrel and across said plurality of diamond cutters to cool and wash the cutters;

thereby to excavate a relatively large diameter shaft around a hard earthen core.

25. A method of pile construction according to claim 24, wherein each of said plurality of diamond cutters has a substantially flat cutting face formed from material composed at least in part of diamond for cutting the kerf principally by abrasion.

* * * * *